US007928961B2

(12) United States Patent
Garfio et al.

(10) Patent No.: US 7,928,961 B2
(45) Date of Patent: Apr. 19, 2011

(54) UNIVERSAL REMOTE CONTROL OR UNIVERSAL REMOTE CONTROL/TELEPHONE COMBINATION WITH TOUCH OPERATED USER INTERFACE HAVING TACTILE FEEDBACK

(75) Inventors: Alejandro Garfio, Pico Rivera, CA (US); Sandro David Klein, Cypress, CA (US); Jeremy K. Black, Santa Ana, CA (US)

(73) Assignee: Universal Electronics Inc., Cypress, CA (US)

( * ) Notice: Subject to any disclaimer, the term of this patent is extended or adjusted under 35 U.S.C. 154(b) by 909 days.

(21) Appl. No.: 11/791,067

(22) PCT Filed: Dec. 17, 2004

(86) PCT No.: PCT/US2004/042784

§ 371 (c)(1),
(2), (4) Date: May 18, 2007

(87) PCT Pub. No.: WO2006/065252

PCT Pub. Date: Jun. 22, 2006

(65) Prior Publication Data

US 2008/0117085 A1 May 22, 2008

(51) Int. Cl.
*G09G 5/00* (2006.01)

(52) U.S. Cl. ..... 345/156; 345/169; 455/556.1

(58) Field of Classification Search ..... 345/156, 345/169, 173; 455/556, 556.1–556.2; 715/716, 715/835

See application file for complete search history.

(56) References Cited

U.S. PATENT DOCUMENTS

| | | | | |
|---|---|---|---|---|
| 4,060,703 | A | 11/1977 | Everett, Jr. | |
| 4,127,752 | A | 11/1978 | Lowthorp | |
| 4,423,294 | A | 12/1983 | Walser et al. | |
| 5,138,119 | A | 8/1992 | Demeo | |
| 5,636,211 | A | 6/1997 | Newlin et al. | |
| 5,802,460 | A | 9/1998 | Parvulescu et al. | |
| 5,811,930 | A | 9/1998 | Krafcik et al. | |
| 5,818,361 | A | 10/1998 | Acevedo | |
| 5,963,624 | A | 10/1999 | Pope | |
| 6,028,591 | A | 2/2000 | Lueders | |
| 6,198,481 | B1 * | 3/2001 | Urano et al. | 715/835 |
| 6,223,029 | B1 | 4/2001 | Stenman et al. | |
| 6,243,080 | B1 * | 6/2001 | Molne | 345/173 |

(Continued)

FOREIGN PATENT DOCUMENTS

| | | | |
|---|---|---|---|
| EP | 0566516 | A | 10/1993 |

(Continued)

OTHER PUBLICATIONS

Supplementary European Search Report for PCT/US2004/042784 dated Nov. 3, 2009.

*Primary Examiner* — Kimnhung Nguyen
(74) *Attorney, Agent, or Firm* — Greenberg Traurig, LLP

(57) ABSTRACT

A touch operated user interface having tactile feedback for use in connection with a universal remote control or universal remote control with cordless phone functionality is shown in FIG. 13. Surface features are provided as part of or as an overlay (1300) to a touchable face area of the user interface in order to assist the user in locating key positions and/or to provide positive indication of key activation. The overlay is placed over a flexible electroluminescent panel (318) that provides a lighted indication and a plurality of dome switches (310) that function as keys.

25 Claims, 12 Drawing Sheets

U.S. PATENT DOCUMENTS

| | | | | |
|---|---|---|---|---|
| 6,292,210 | B1 | 9/2001 | Gerszberg et al. | |
| 6,609,805 | B1 | 8/2003 | Nelson | |
| 6,628,964 | B1 | 9/2003 | Bates et al. | |
| 6,667,759 | B2 | 12/2003 | Gerszberg et al. | |
| 6,677,931 | B2 | 1/2004 | Chi et al. | |
| 6,697,467 | B1 | 2/2004 | Schultz et al. | |
| 6,747,402 | B2 | 6/2004 | Hato et al. | |
| 6,794,992 | B1 | 9/2004 | Rogers | |
| 6,947,101 | B2 * | 9/2005 | Arling | 348/734 |
| 2001/0041590 | A1 * | 11/2001 | Silberfenig et al. | 455/556 |
| 2001/0055954 | A1 * | 12/2001 | Cheng | 455/74.1 |
| 2005/0008332 | A1 * | 1/2005 | Ogikubo et al. | 386/69 |
| 2005/0009567 | A1 * | 1/2005 | Holmes | 455/563 |

FOREIGN PATENT DOCUMENTS

| | | | |
|---|---|---|---|
| WO | WO 98/11576 | A | 3/1998 |
| WO | WO 03/044625 | A | 5/2003 |

* cited by examiner

UNIVERSAL REMOTE CONTROL OR UNIVERSAL REMOTE CONTROL/TELEPHONE COMBINATION WITH TOUCH OPERATED USER INTERFACE HAVING TACTILE FEEDBACK

BACKGROUND OF THE INVENTION

This invention relates generally to electronic devices and, more particularly, relates to a universal remote control or universal remote control/telephone combination with touch operated user interface having tactile feedback.

Remote controls including universal remote controls for controlling the operation of home appliances are well known. In this regard, a universal remote control functions by consolidating three, four, five, and more remote controls into one device. Also known in the art is combining the functionality of a universal remote control and a cordless telephone handset into a single unit as contemplated by, for example, U.S. Pat. No. 5,138,649 entitled "Portable Telephone Handset with Universal Remote Control" which patent is incorporated herein by reference in its entirety.

As more remotely controllable appliances enter the homes of consumers and the number of remotely controllable operations increase, the user interface of the universal remote control becomes increasingly more complex. This complexity arises from the need to provide more and more keys which are used to initiate the transmission of the control codes that control the burgeoning number of operations of the increasing number of home appliances. When included, the addition of telephone functionality further increases the complexity, or clutter, of the user interface. Disadvantageously, as the user interface of the universal remote control becomes more cluttered, the usability of the universal remote control diminishes.

In an attempt to solve this problem, universal remote controls which comprise a touch screen or touch screen-like interface, for example, a transparent or translucent touch sensitive surface overlaid upon an LCD, or a flexible EL display panel positioned above a grid of pressure sensitive switches, have been proposed. Thus, by selectively illuminating portions of the LCD or EL segments, the user may be presented with keys (i.e., "soft keys") to command different functions for different appliances in manner that serves to relatively simplify the user interface. Such universal remote control devices/interfaces are described in, for example, commonly assigned U.S. patent application Ser. Nos. 10/288,727 entitled "User Interface for a Hand Held Universal Remote Control Device" and 10/410,103 entitled "Universal Remote Control with a Local Screen Guided Setup," which published applications for patent are hereby incorporated by reference in their entirety.

While this technology has served to simplify operation of universal remote controls, a new disadvantage is introduced by this technology, that being a lack of tactile feedback to assist the user in locating a key position and/or in the perception of key actuation. Accordingly, a need exists for a universal remote control, with or without added cordless telephone functionality, having an improved user interface that simplifies the operation of the universal remote control and, as such, the remote operation of consumer appliances, while still providing appropriate tactile feedback to a user.

SUMMARY OF THE INVENTION

In accordance with these and other needs, a touch operated user interface having tactile feedback for use in connection with a universal remote control or universal remote control with cordless phone functionality is provided. In particular, surface features are provided as part of or as an overlay to a touchable face area of the user interface in order to assist the user in locating key positions and/or to provide positive indication of key activation. A more complete understanding of the advantages, features, properties and relationships of the touch operated user interface having tactile feedback for use in connection with a universal remote control or universal remote control combined with a cordless phone will be obtained from the following detailed description and accompanying drawings which set forth illustrative embodiments indicative of the various ways in which the principles described hereinafter may be employed.

BRIEF DESCRIPTION OF THE DRAWINGS

For a better understanding of the touch operated user interface having tactile feedback for use in connection with a universal remote control or universal remote control combined with a cordless phone, reference may be had to preferred embodiments shown in the following drawings in which.

DETAILED DESCRIPTION

Figure 1:
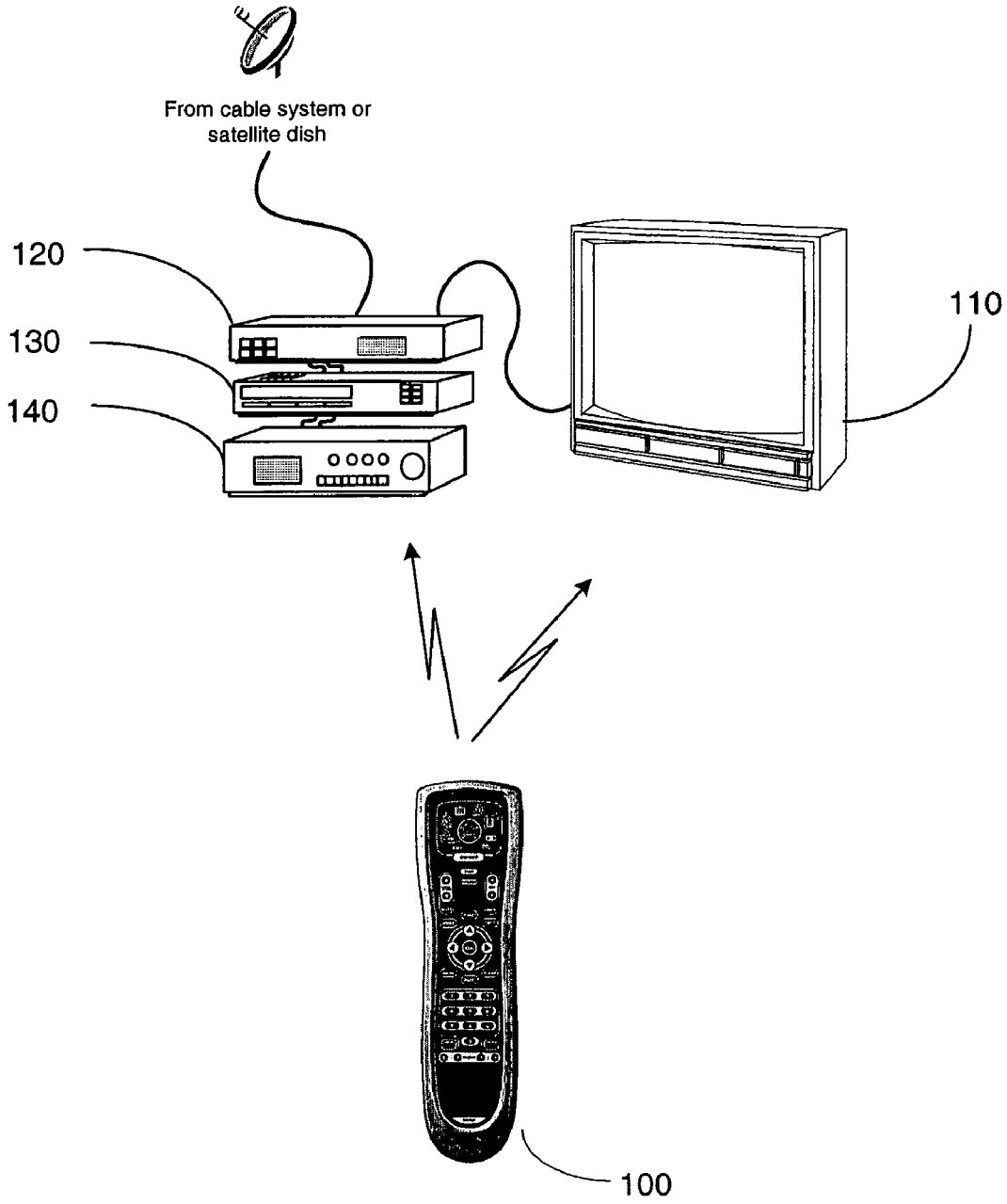
FIG. 1 illustrates an exemplary universal remote control as part of a system including a plurality of controllable appliances.

With reference to the figures, wherein like reference numerals refer to like elements, a universal remote control 100 and a universal remote control with cordless phone functionality 200 each having an EL display for presenting multiple universal remote control user interfaces are described. In this regard, each of the multiple user interfaces provides a user with the ability to use the universal remote control to command functional operations of one or more appliances of various types and various manufacturers, and in the case of universal remote control 200, to also command the operation of a cordless telephone system (also to be considered "an appliance"). For example, the universal remote controls 100, 200 may include a mechanism, e.g., one or more device mode keys, a scroll wheel, navigation keys, or the like, for placing the universal remote controls 100, 200 into an operating mode for transmitting commands that are appropriate for the one or more appliances that have been assigned to or setup for that operating mode. In connection with being placed into a particular operating mode, one or more segments in the EL display may be selectively illuminated, in a manner described hereinafter, to present a user interface that is appropriate for that operating mode. It will also be appreciated that each operating mode may also have multiple user interface pages each of which may present one or more function keys that are appropriate for commanding the one or more appliances assigned to or setup for that operating mode, e.g., an user interface page providing a numerical keypad, an user interface page providing transport function keys, an user interface page providing menu navigation function keys, etc. Among other things, the use of multiple user interface pages in an operational mode (between which a user may navigate) having logical groupings of function keys has the advantage of providing function keys to a user in a relatively less cluttered manner. The same universal remote control interface page may also be included in a set of user interface pages across multiple operational modes.

By way of example, FIG. 1 illustrates an exemplary system including controllable appliances, such as a set top box ("STB") 120, a VCR 130, an audio amplifier/receiver 140, and a television 110, which may be commanded through the use of universal remote control 100. More particularly, the universal remote control 100 is capable of transmitting commands to the appliances, using any convenient IR, RF, Point-to-Point, or networked protocol, to cause the appliances to perform operational functions. While illustrated in the context of a STB 120, VCR 130, audio system 140 and television 110, it is to be understood that controllable appliances can include, but are not limited to, televisions, VCRs, DVRs, DVD players, cable or satellite converter set-top boxes ("STBs"), amplifiers, CD players, game consoles, home lighting, drapery, fans, HVAC systems, thermostats, personal computers, etc.

Figure 2:
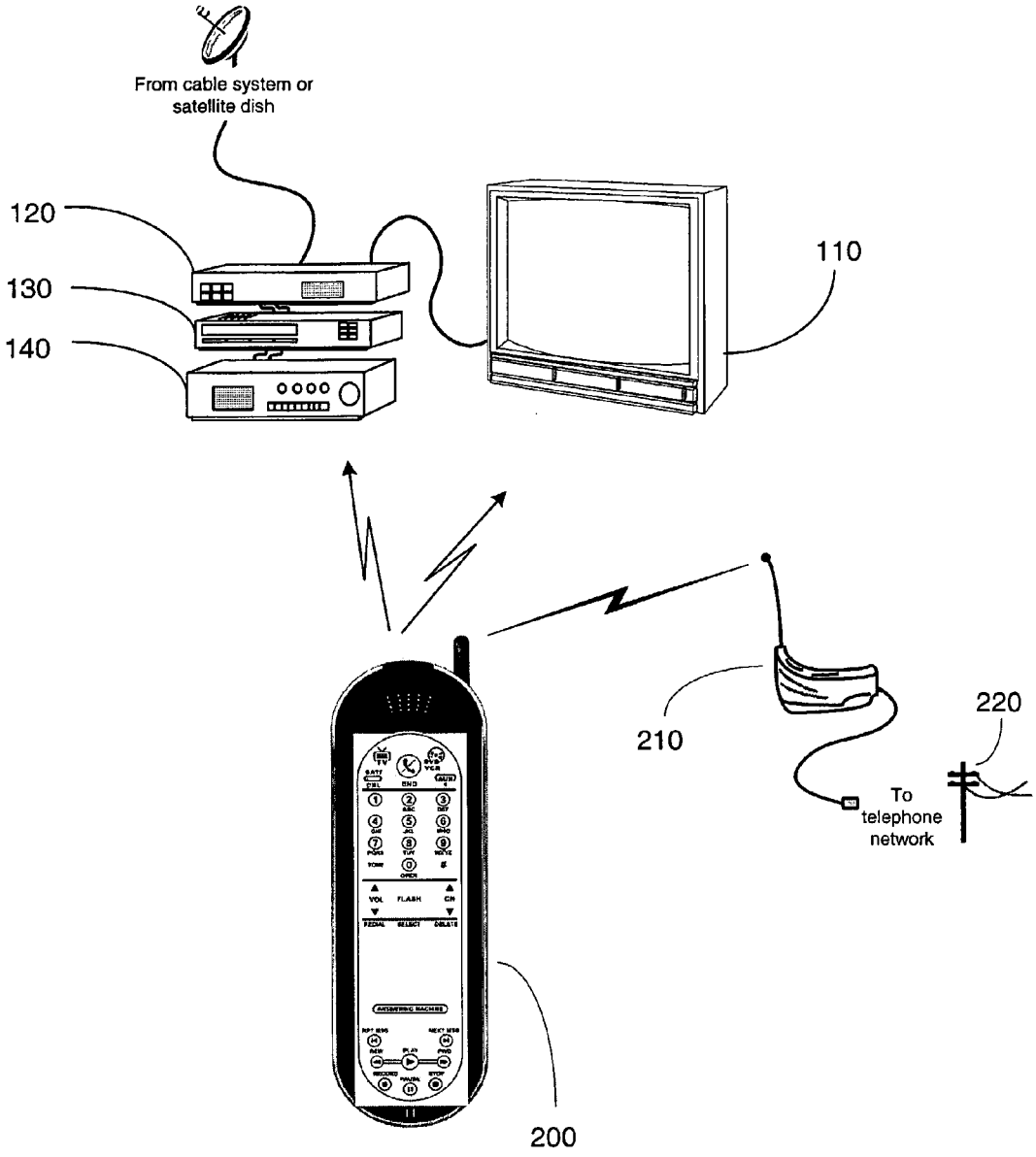
FIG. 2 illustrates an exemplary universal remote control with cordless telephone functionality as part of a system including a plurality of controllable appliances.

By way of further example, FIG. 2 illustrates an exemplary system including an alternative universal remote control embodiment 200 which includes cordless telephone functionality. In addition to offering control of appliances 110, 120, 130 and 140 in a manner similar to that described above, universal remote control 200 may further be placed into a mode wherein it functions as a cordless telephone handset, communicating via a two-way RF signal with base station 210 which is in turn attached to the telephone network 220 via the usual connector. It will be appreciated that in this exemplary system, base station 210 may also serve as a recharging station for the universal remote control 200. In one embodiment, base station 210 may also incorporate telephone answering machine functionality which may be further remotely controlled via transmissions from the universal remote control 200. It will be further appreciated that the phone may be a cellular phone in certain embodiments communicating with a cellular phone tower in a conventional manner.

Figure 3:
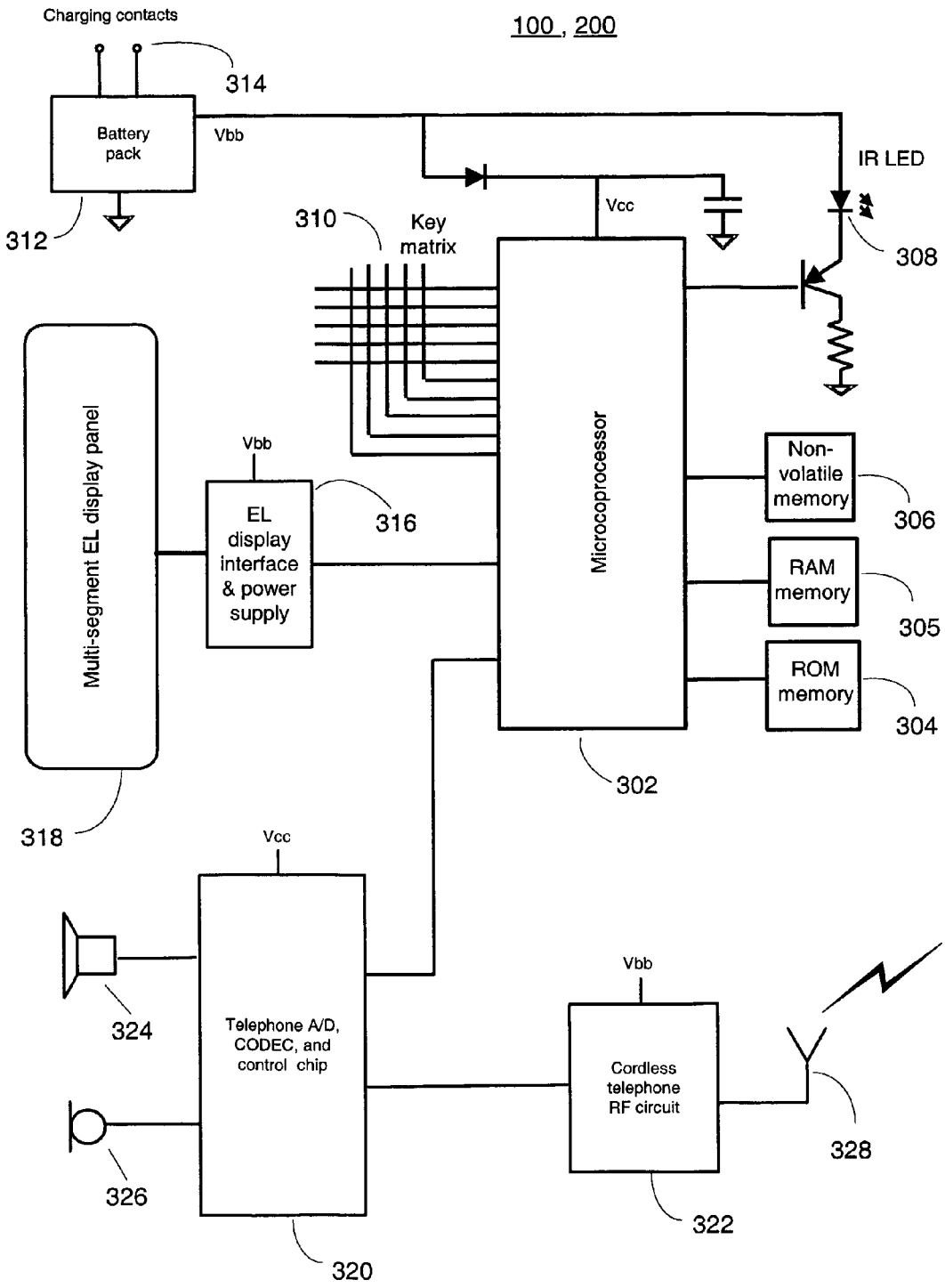
FIG. 3 illustrates in block diagram form the component parts of the universal remote control of FIGS. 1 and 2.

Turning now to FIG. 3, for use in commanding the functional operations of one or more appliances, the universal remote control 100, 200 may include, as needed for a particular application, a processor 302 coupled to a memory device (such as ROM memory 304, RAM memory 305, and/or a non-volatile read/write memory 306) a key matrix 310 (e.g., dome style switch contact array, silicon rubber keypad, or a combination thereof), a segmented, electroluminescent ("EL") display panel 318 overlaying the key matrix 310, EL display interface electronics 316, transmitter circuit 308 for communicating with the appliances to be controlled (e.g., IR and/or RF), and a power source 312 which may be rechargeable via contacts 314. It will be appreciated that in certain embodiments power source 312 may alternately comprise replaceable batteries in which case recharging contacts 314 are not required. A universal remote control/cordless telephone combination handset 200 of the type illustrated in FIG. 2 may additionally include a telephone control chip 320, an earphone 324 (or speaker), a microphone 326, and an RF transceiver circuit 322 with antenna 328 for communication with base station 210. All of these components are well known in the art, thus for the sake of brevity they will not be discussed in further detail herein.

As will be understood by those skilled in the art, the memory device may include executable instructions that are intended to be executed by the processor 302 to control the operation of the universal remote control 100, 200. In this manner, the processor 302 may be programmed to control the various electronic components within the universal remote control 100, 200, e.g., to monitor the power supply, to cause the transmission of signals, place the telephone circuit in the off-hook or on-hook state, etc. The non-volatile read/write memory 306, for example an EEPROM, Flash, battery-backed up RAM, Smart Card, memory stick, or the like, may be provided to store setup data and parameters as necessary. While the memory 304 is illustrated and described as a ROM memory, memory 304 can also be comprised of any type of readable media, such as ROM, RAM, SRAM, FLASH, EEPROM, or the like which may also be non-volatile or battery-backed such that data is not required to be reloaded after battery changes. In addition, the memory devices may take the form of a chip, a hard disk, a magnetic disk, an optical disk, and/or the like. Still further, it will be appreciated that some or all of the illustrated memory devices may be physically incorporated within the same IC chip as the processor 302 (a so called "microcontroller") and, as such, they are shown separately in FIG. 3 only for the sake of clarity.

Figure 4:
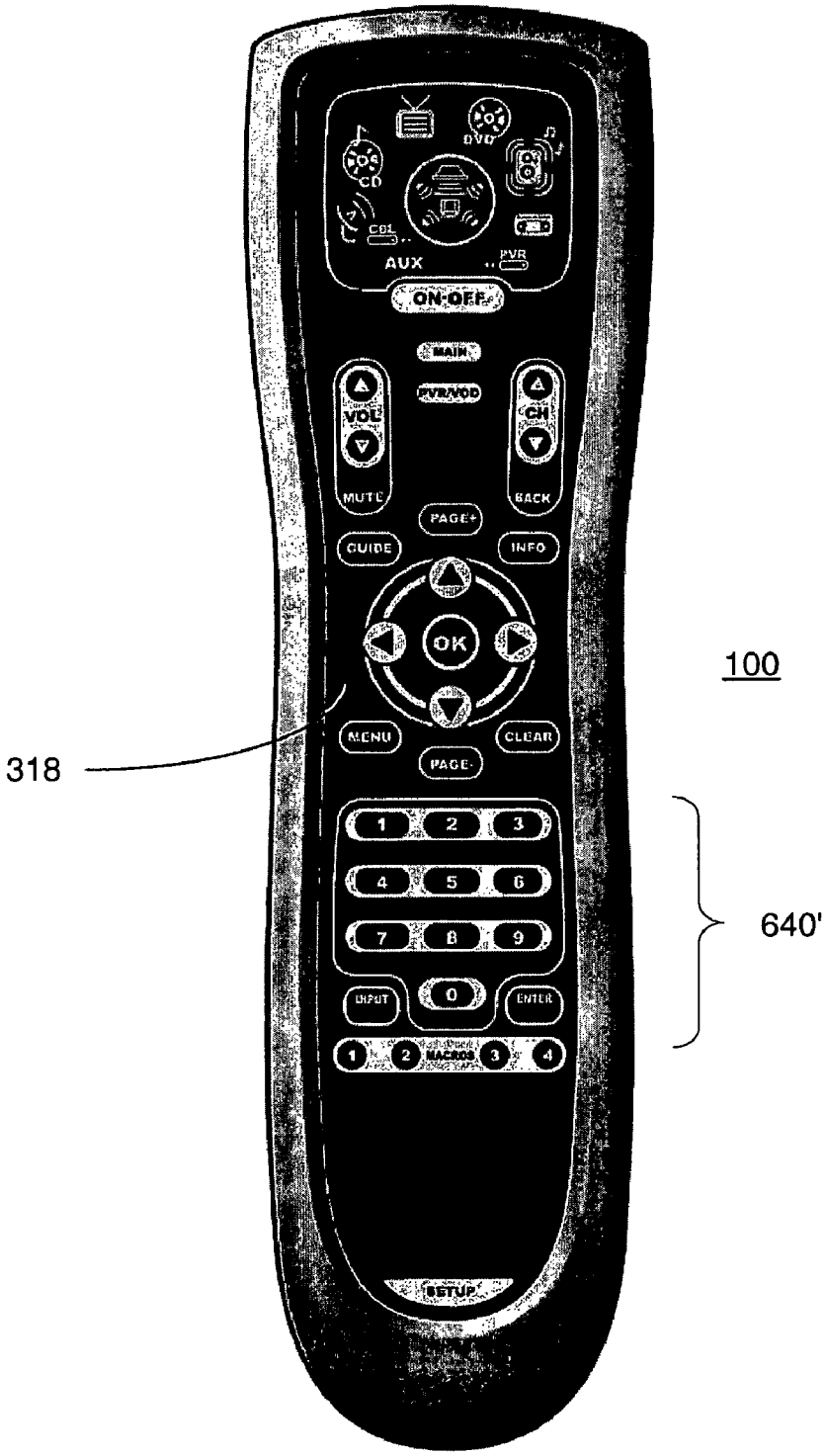
FIG. 4 illustrates an exemplary universal remote control having an electroluminescent ("EL") panel display.

Unlike conventional universal remote controls which are usually constructed using silicon rubber keypads protruding through cut-outs in a hard plastic upper housing, universal remote controls 100, 200 use a flexible, segmented electroluminescent ("EL") panel 318 that is overlaid over a dome switch style key matrix 310. Flexible EL panel 318 may comprise addressable segments arranged in various shapes which may be selectively illuminated to form icons or soft keys, for example as illustrated in FIG. 4. In this manner, pressure applied to a universal remote control user interface icon on EL panel 318 will cause it to flex and result in actuation of a corresponding underlying dome switch in the key matrix 310, the combination thus forming a function key as will be further described hereafter in connection with FIGS. 12 through 15. In the illustrated examples, the EL display panels 318 may be constructed as described in PCT patent application WO 00/72638 which is assigned to Cambridge Consultants Ltd. and which is incorporated herein by reference in its entirety. This allows various parts of the display to be independently illuminated under control of the microprocessor 302 and EL display interface 316 to thereby present universal remote control user interface icons over select areas of the key matrix 310. The advantage of such a construction is that different elements may be illuminated at different times, depending on the activity currently being performed by the user (i.e., depending upon a mode the universal remote control has been placed into).

Figure 5:
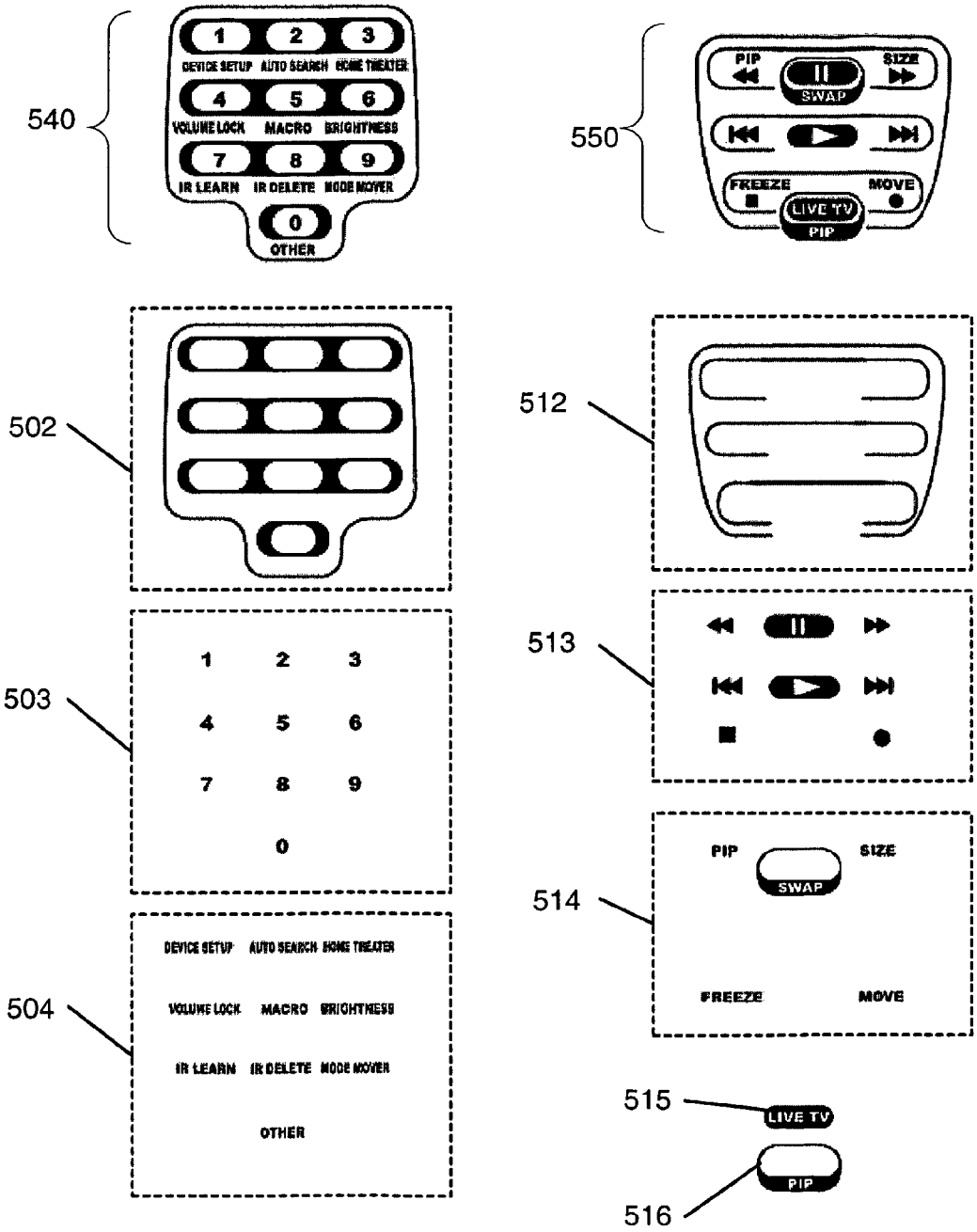
FIG. 5 illustrates exemplary display segments of the universal remote control of FIG. 4.
Figure 6:
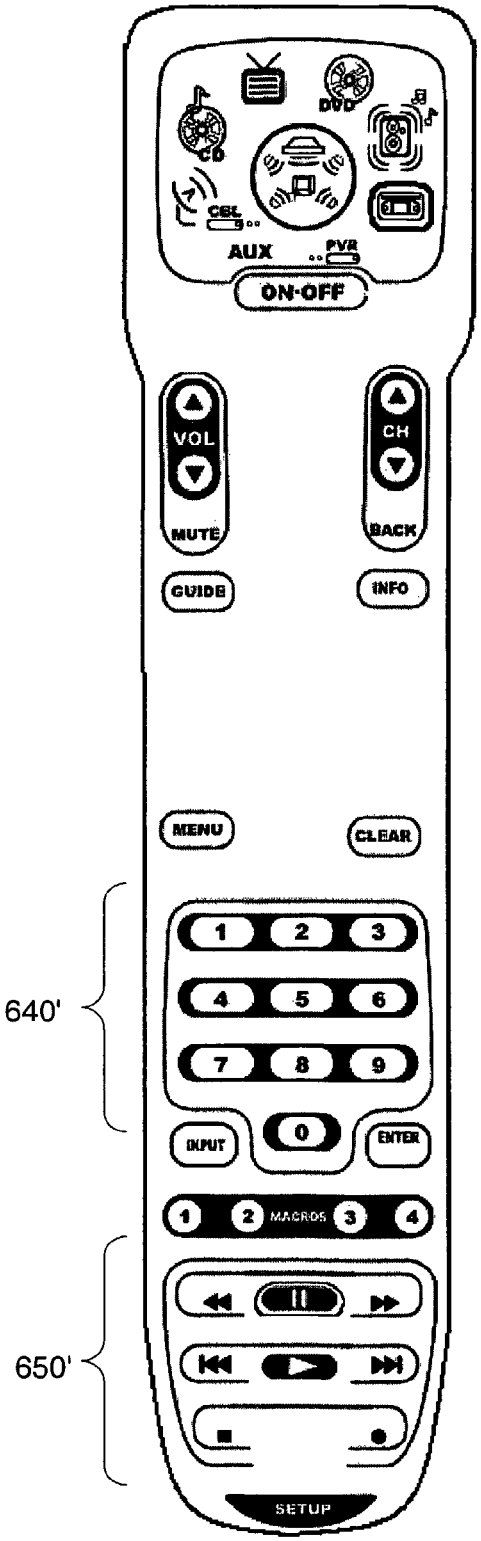
FIGS. 6 through 9 illustrate exemplary screen displays of a user interface of the universal remote control of FIG. 4.
Figure 7:
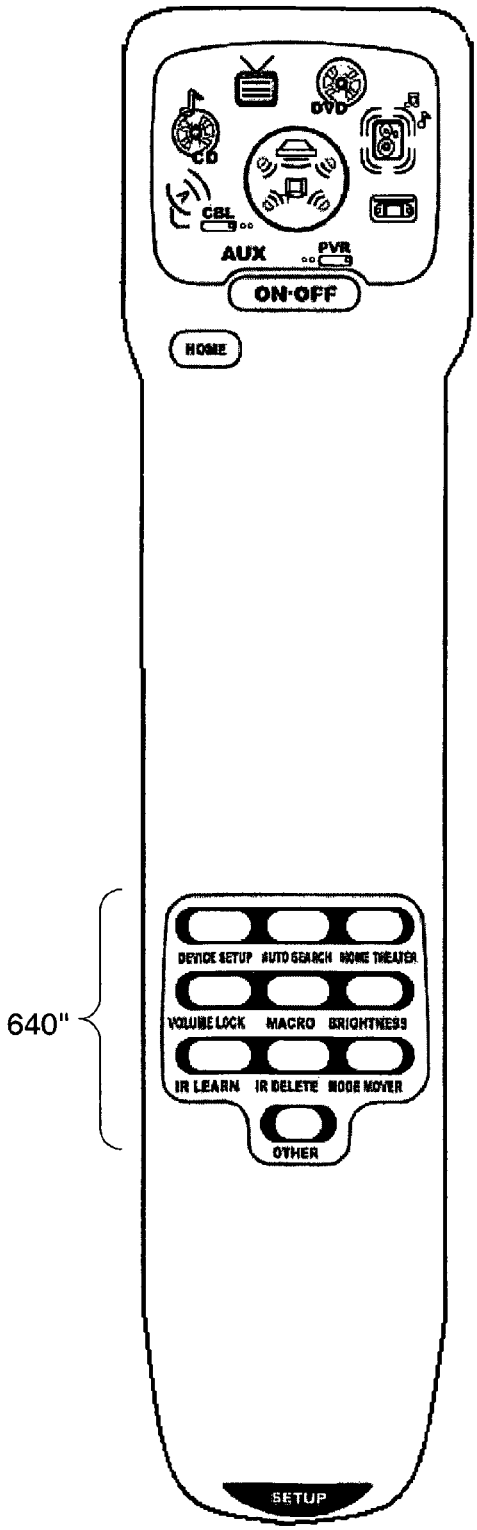
Figure 8:
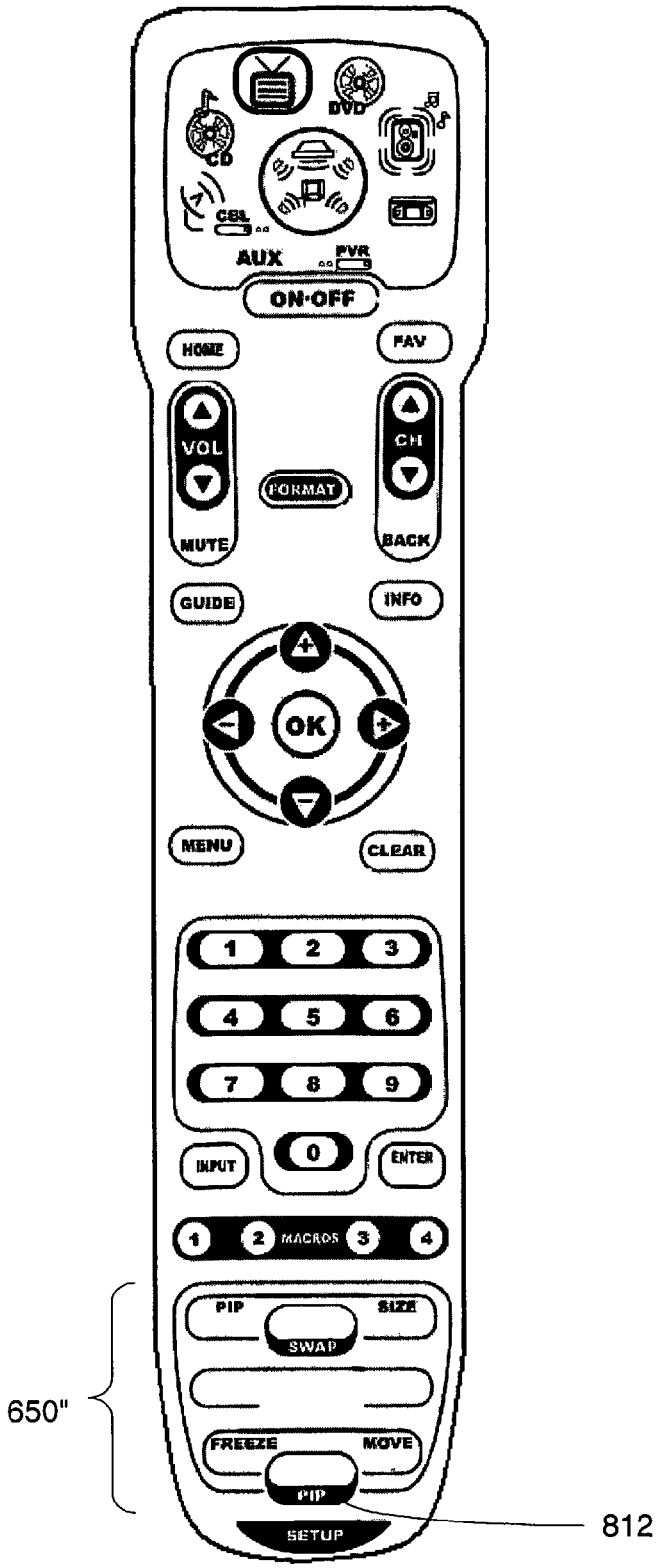
Figure 9A:
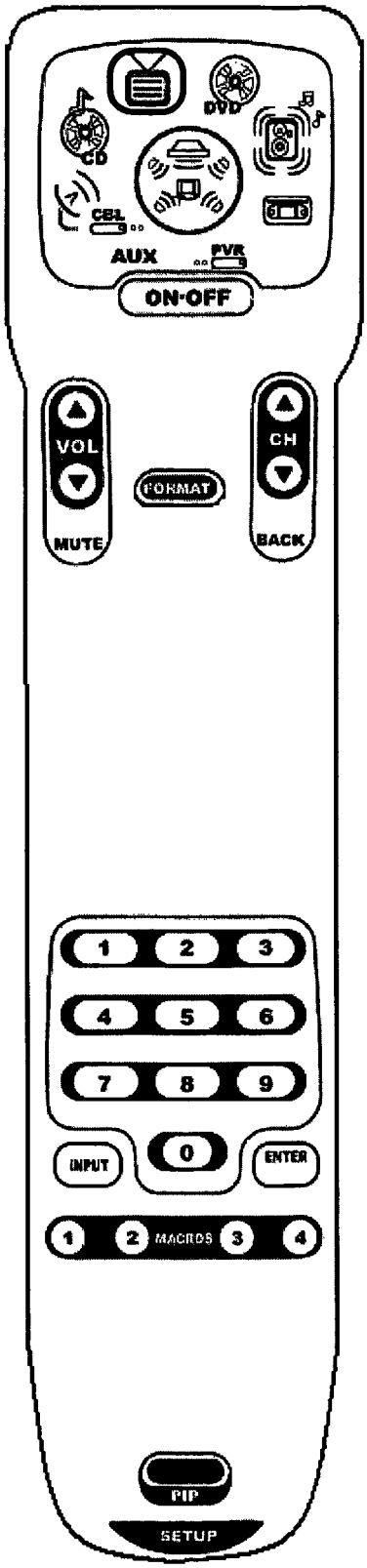
Figure 9B:
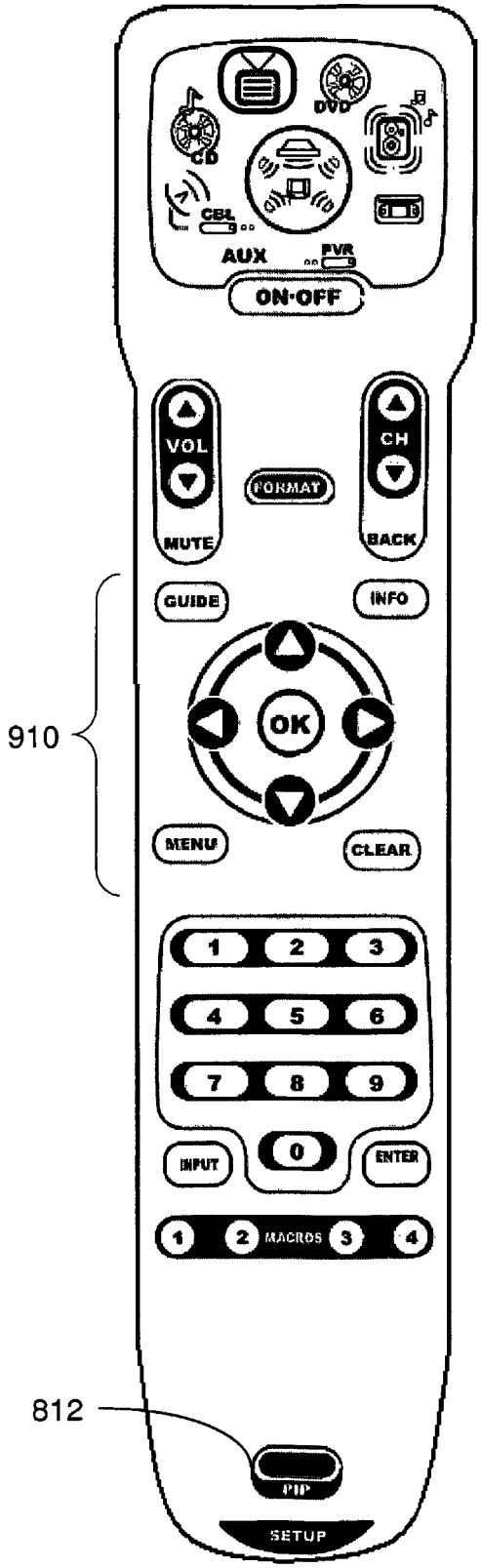

By way of a more detailed example, the numeric keypad portion 540 of the EL panel of universal remote control 100 may be arranged as three separately controllable segments 502, 503, and 504, as illustrated in FIG. 5. To achieve the numeric pad appearance 640', shown for example in FIG. 4 or 6, segments 502 and 503 are illuminated by the microprocessor. Similarly, to achieve the appearance 640", corresponding to a setup mode and shown for example in FIG. 7, segments 502 and 504 are illuminated. A function key area, e.g., the transport key/picture-in-picture control area 550, may also be arranged into segments 512, 513, 514, 515, and 516. To achieve the appearance 650', shown for example in FIG. 6, only segments 512 and 513 are illuminated. In order to achieve the appearance 650", shown for example in FIG. 8, segments 512, 514, and 516 are illuminated. This ability to independently illuminate various parts of the display may also be used to selectively illuminate groups of function keys which correspond to functions applicable to a particular device to be controlled by the universal remote control 100, 200. By way of example, FIGS. 9*a* and 9*b* illustrate how the keypad display may appear for use in controlling the operation of a television device which supports menu functionality 910 (FIG. 9*b*) versus the keypad display for use in controlling the operation of a television which does not support menu functionality (FIG. 9*a*). Thus, it will be appreciated that under a touch area of the user interface one of multiple different icons available for use in connection with that touch area may be displayed to the user to thereby provide multiple different user interfaces. For additional explanation regarding the display of function keys considering functionality of a device, reference may be had to co-pending U.S. patent application Ser. No. 09/905,396 "Hand Held Device Having a Browser Application" which is incorporated herein by reference in its entirety.

The ability to independently illuminate various parts of the display may be further used to display various key functionalities via the user interface according the current state of the intended target device (i.e., the device to which commands are to be transmitted). An example of this is shown in FIGS. 9*b* and 8 where activation of the "PIP" key 812 by the user not only transmits the universal remote control command to toggle the television device in and out of a picture-in-picture mode, but also controls availability (i.e., the display of function keys for activation) of the key set 650" (FIG. 8) used to control the picture-in-picture display as a function of the PIP state the television device is commanded to enter.

Figures 10A, 10B:
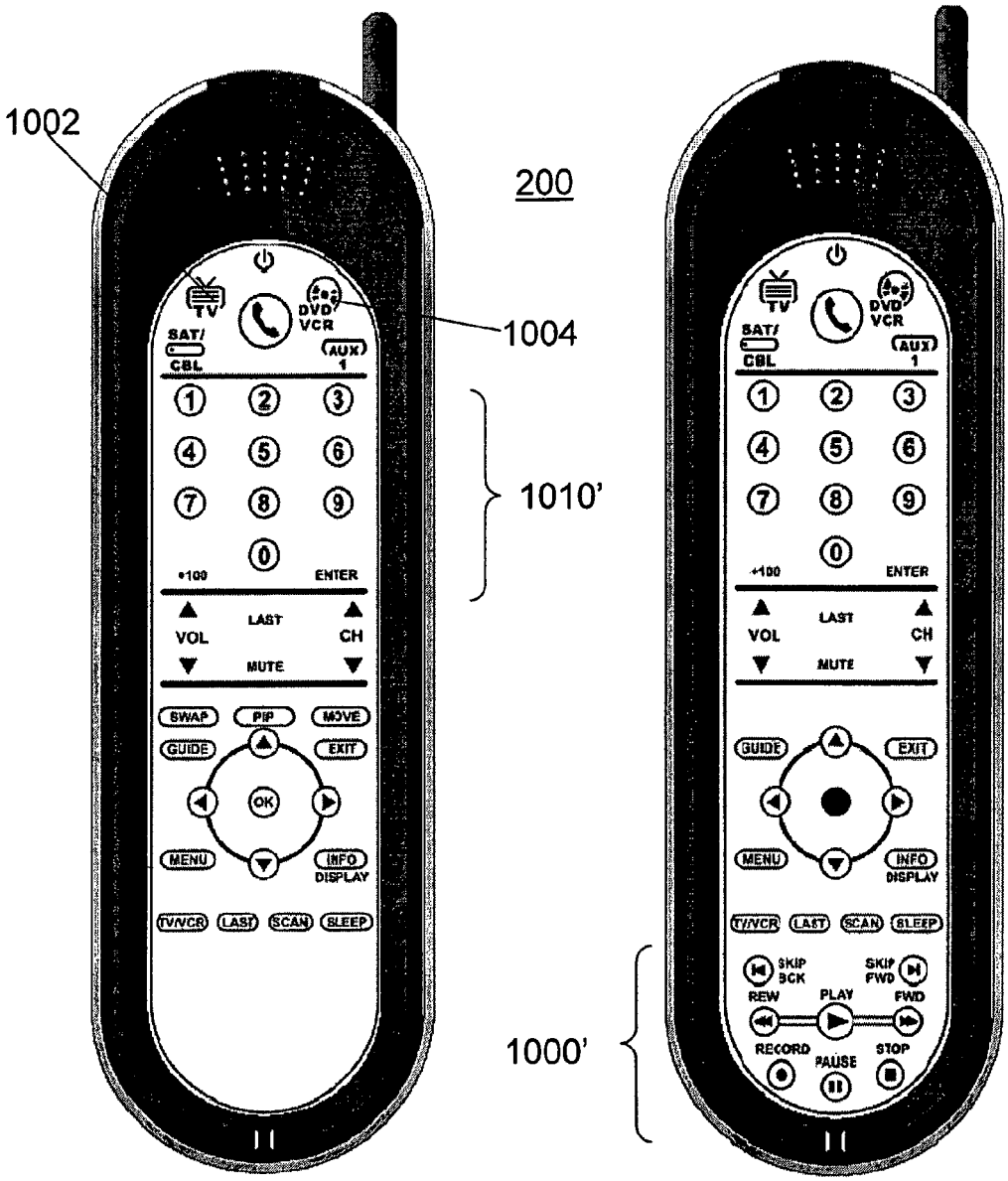
FIGS. 10 and 11 illustrate an exemplary universal remote control with cordless phone functionality having an electroluminescent ("EL") panel display showing various exemplary user interfaces.
Figures 11A, 11B:
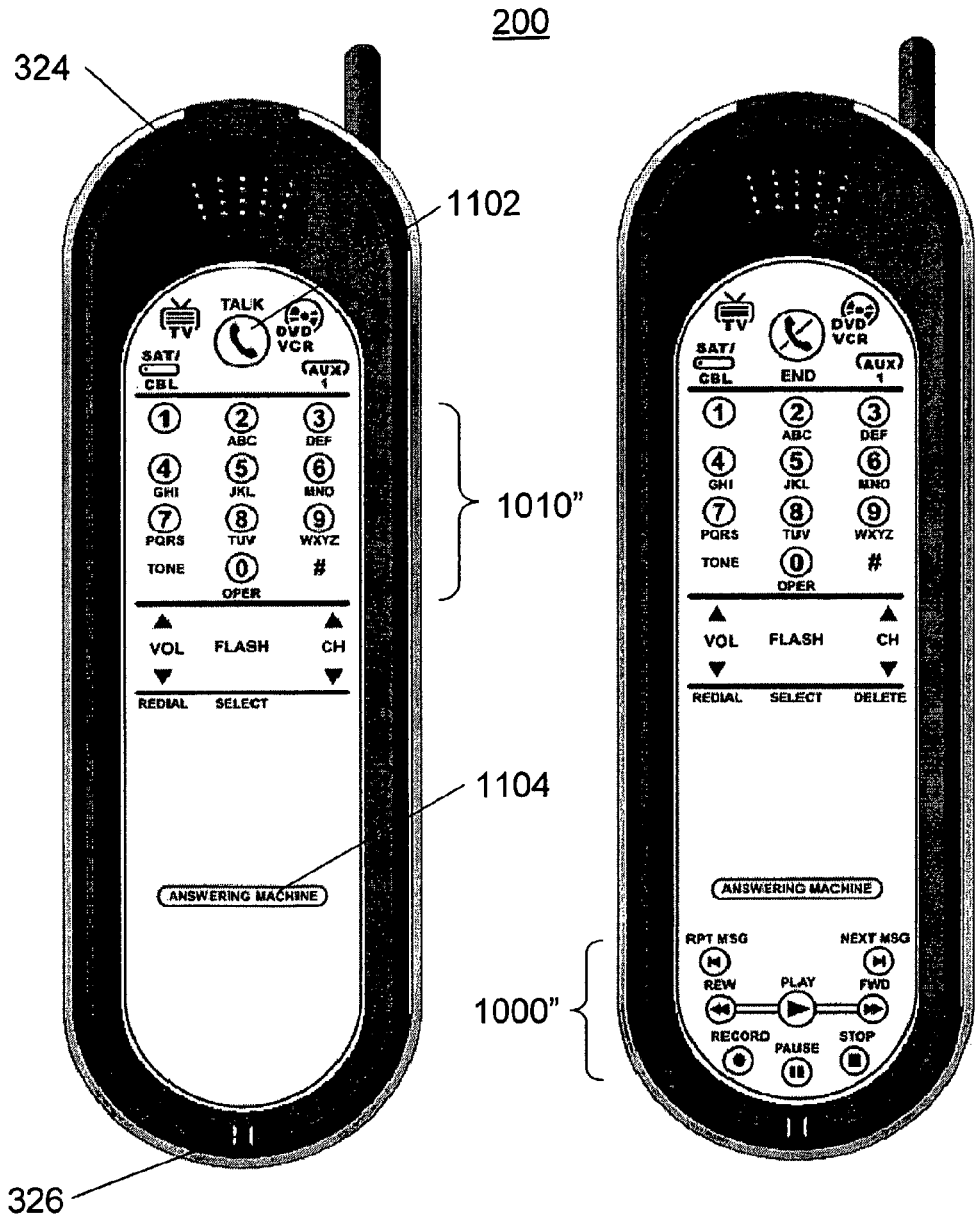

Turning now to FIGS. 10 and 11, there is illustrated an alternative embodiment of a universal remote control device 200 constructed using an addressable segmented EL panel. In this example, universal remote control 200 may include a cordless telephone capability as described earlier. In this instance, the addressable, independently illuminable EL segments may be arranged to present user icons suitable for universal remote control of entertainment equipment as shown in FIG. 10 or suitable for operation of the cordless telephone capability as illustrated in FIG. 11. By way of further explanation, FIG. 10*a* illustrates how the keypad display of device 200 may appear as part of a user interface for controlling functions of a television (this mode of universal remote control operation being entered by actuation, for example, of a TV mode key 1002), while FIG. 10*b* illustrates how the keypad display of device 200 may appear as part of a user interface for controlling functions of a DVD or VCR device (this mode of universal remote control operation being entered by actuation, for example, of a DVD/VCR key 1004). FIG. 11*a* illustrates how the keypad display of device 200 may appear as part of a user interface for communicating with (i.e., commanding) the cordless phone base station when the cordless telephone mode of operation is activated by, for example, actuation of the "Telephone" key 1102. A comparison of FIGS. 10*a* and 11*a* will reveal how selective illumination of various segments in the manner described earlier may be used to adapt a numeric keypad icon set 1010 of the user interface for the different modes of operation 1010' (e.g., to control a television) and 1010" (e.g., to communicate with a phone base station).

The cordless telephone capability of device 200 may also include the ability to control an answering machine (for example, built into base station 210) by activation of an "Answering Machine" icon 1104. Activation of the answering machine mode of operation may result in the illumination of specific additional user interface elements 1000" as illustrated in FIG. 11*b*. Again, a comparison of FIGS. 10*b* and 11*b* will reveal how selective illumination of various segments may be used to adapt a transport key group 1000 of a user interface for different modes of operation 1000' (e.g., to control a DVD player) and 1000" (e.g., to control an answering machine).

Additionally, given that base station 210 includes wireless capabilities for communicating with device 200 and connections to both a powerline and phone line (for transferring power signals and telephony signals respectively to base station 210) base station 210 may be optionally configured with components and programming to enable command passing/bridging, control, and media playback functions within a desired control environment. By way of example, in one embodiment base station 210 may include the ability to transfer commands received from universal remote control device 200 to a powerline based control network (for example X10 or UPB) thereby enabling device 200 to control suitably equipped appliances such as lighting fixtures, thermostats, security systems, spas, etc., located anywhere on the premises. In this context it will be appreciated that although described above in terms of a simple powerline based system, such base station command transfer capabilities may in general encompass one or more of powerline, phone line, structured wiring, hardwired, wireless (RF or IR), or any other suitable control network technology. Alternatively or in addition, base station 210 may be configured with remote beaconing and/or location signaling components and programming as described more fully in commonly assigned and co-pending U.S. Provisional Application 60/517,558 entitled "System and Method for Controlling Device Location Determination" which is incorporated herein by reference in its entirety. Base station 210 may also be configured as a control centric device and/or content server for enabling various command and content based functions via one or more existing control networks (i.e., RF, powerline, phoneline, etc. based networking methods, or a combination of the above) as more fully described in co-pending U.S. Provisional Application 60/517,283 entitled "Home Appliance Control System and Methods in a Networked Environment" which is owned by a common assignee and incorporated herein by reference in its entirety. Additional extended control functions (such as the ability to pause and resume appliance states across multiple control environments or zones) may be implemented via one or more base stations by incorporating features and functions of a central data/state server (such as a media server, control pod, PC, etc. connected to one or more devices of the home entertainment center), which is more fully described in co-pending U.S. Application 60/517,737 entitled "System And Method For Saving And Recalling State Data For Media And Home Appliances" which is owned by a common assignee and incorporated herein by reference in its entirety.

Figure 12:
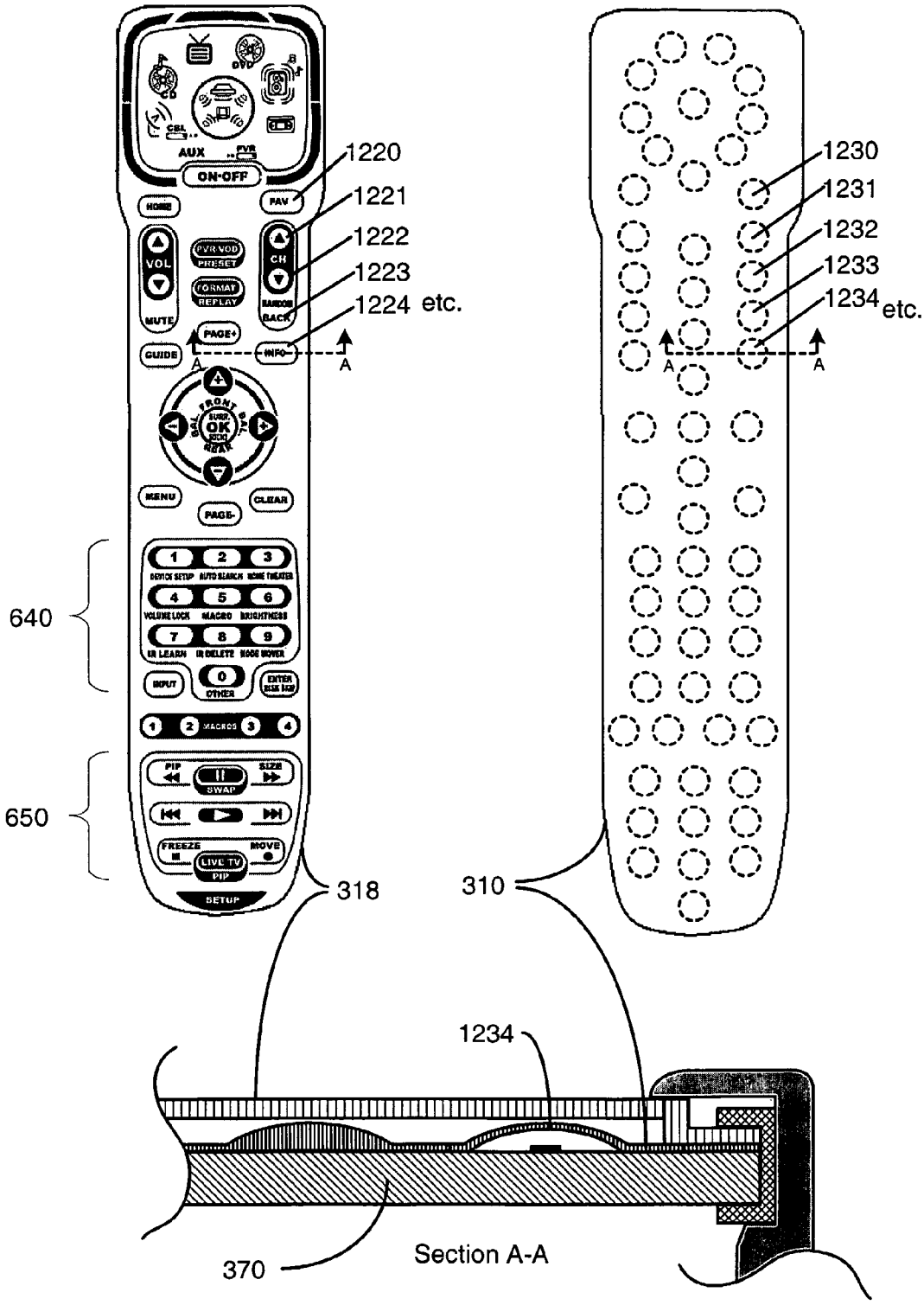
FIGURE 12 (Prior art)
FIG. 12 illustrates a prior art mechanical construction of a keypad for use as part of a user interface.

Referring now to FIGS. 12 through 15, the mechanical construction of exemplary embodiments of a universal remote control incorporating a flexible EL panel with selectively illuminable segments will be described in more detail. In a previously disclosed embodiment—which is illustrated in FIG. 12 and disclosed previously in, for example, U.S.

patent application Ser. No. 10/410,103—a flexible EL panel 318 is disposed above an array of mylar dome switches 310 such that pressure applied to, for example, any of the graphical user interface icons 1220 . . . 1224, etc., will result in the corresponding dome switch 1230 . . . 1234, etc. making contact with the underlying printed circuit board 370 to complete a circuit, whereby individual universal remote control functions are selected by the user.

Figure 13:
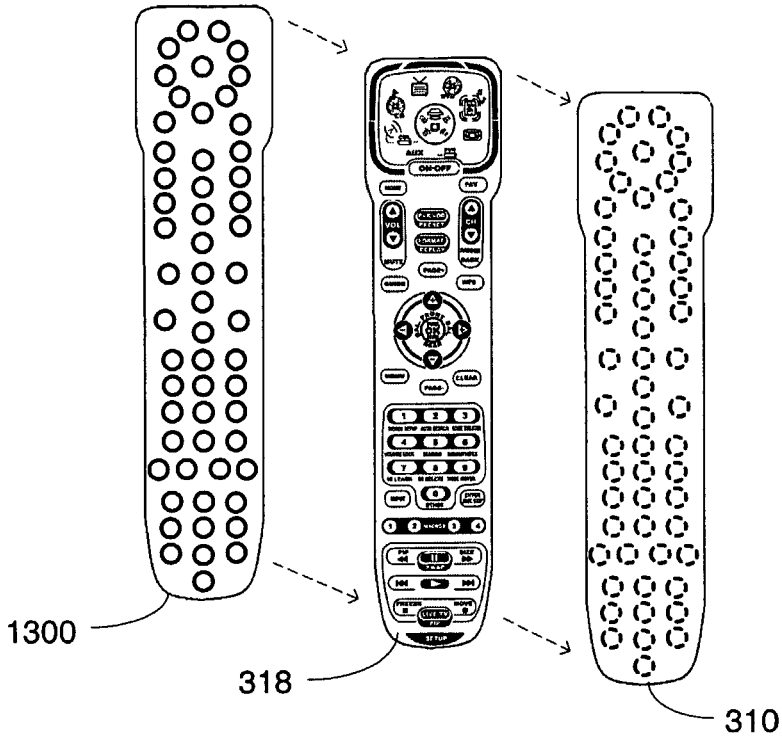
FIG. 13 illustrates a mechanical construction of a keypad including tactile feedback for use as part of a user interface.
Figure 14:
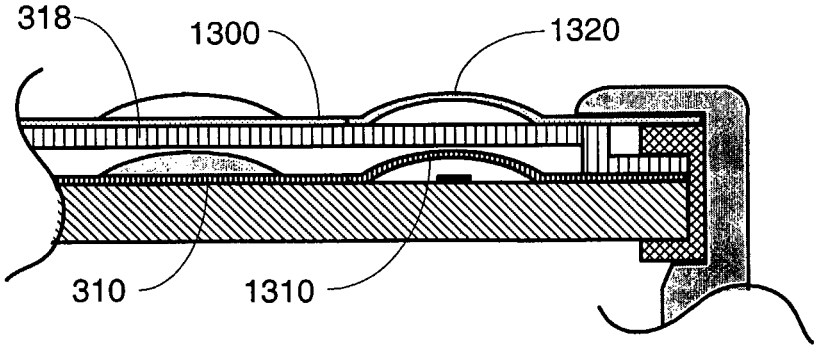
FIGS. 14 and 15 illustrate partial, cross-sectional views of the keypad including tactile feedback of FIG. 13.

Turning now to FIGS. 13 and 14, there is illustrated an improved embodiment in which a transparent or translucent (collectively referred to as "translucent") mylar panel 1300 may be positioned over the upper surface of flexible EL panel 318. This outer mylar panel 1300 serves to enhance tactile feedback to the user of the device, both in locating key positions by touch, e.g., by means of the "bumps" provided by domes 1320 formed in the mylar panel 1300 over the location of user interface keys, as well as providing an additional "click" sensation upon activation of a user interface key via compression of its corresponding dome switch 1320. In this context it be noted that the material of outer sheet 1300 is preferably selected such that the operational force of the outer dome 1320, which is positioned over the illuminable segment(s) of a user interface element and its corresponding dome switch 1310, is greater than that of the inner key matrix dome switch 1310, thus assuring that key contact is completed before the tactile feedback occurs. While illustrated in the form of domes, it will be appreciated that any suitable shape(s) compatible with the mechanics of click-over and restore may be used for the surface features of outer sheet 1300.

Figure 15:
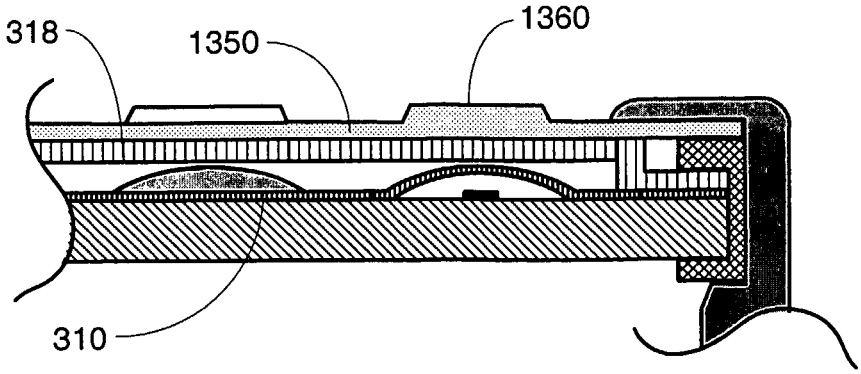

In yet a further exemplary embodiment illustrated in FIG. 15, in cases where the only tactile feedback desired is for the purposes of locating positions of keys in the user interface, a translucent upper sheet 1350 may be formed from molded silicone rubber, cast or embossed mylar, or any other suitable flexible material to provide surface features 1360 or outwardly extending protuberances for use in tactile location of key positions, e.g., the upper sheet 1350 will have a protuberance formed over the illuminable segment(s) of a user interface element and its corresponding dome switch 1310. Once again, any suitable shape may be used for surface features 1360, in this instance without regard to click-over compatibility. For example, the "bumps" positioned over user interface elements that are to be used in connection with channel tuning operations 1010' or phone number dialing 1010" may be formed in shapes corresponding to the numbers 1-9.

While various concepts have been described in detail, it will be appreciated by those skilled in the art that various modifications and alternatives to those concepts could be developed in light of the overall teachings of the disclosure. For example, although described in the context of EL panels, it will be appreciated that the tactile feedback methods of FIGS. 14 through 15 may also be applied to touch sensitive materials used to overlay LCD screens. Alternative embodiments may mix keypad technologies, combining EL panel-based portions with other portions comprising conventional silicone rubber keypads or other key switch technologies. Further, while described in the context of functional modules and illustrated using block diagram format, it is to be understood that, unless otherwise stated to the contrary, one or more of the described functions and/or features may be integrated in a single physical device and/or a software module, or one or more functions and/or features may be implemented in separate physical devices or software modules. It will also be appreciated that a detailed discussion of the actual implementation of each module is not necessary for an enabling understanding of the invention. Rather, the actual implementation of such modules would be well within the routine skill of an engineer, given the disclosure herein of the attributes, functionality, and inter-relationship of the various functional modules in the system. Therefore, a person skilled in the art, applying ordinary skill, will be able to practice the invention set forth in the claims without undue experimentation. It will be additionally appreciated that the particular concepts disclosed are meant to be illustrative only and not limiting as to the scope of the invention which is to be given the full breadth of the appended claims and any equivalents thereof.

All patents cited within this document are hereby incorporated by reference in their entirety.

What is claimed is:

1. A remote control, comprising:

a key matrix having a plurality of switches;

a display disposed in cooperable relationship with the key matrix, the display being illuminable to provide a plurality of different images in association with corresponding ones of the plurality of switches in the key matrix whereby the remote control is provided with the ability to have a plurality of different user interfaces; and wherein an exterior surface of the remote control comprises a layer of flexible, translucent material disposed over the combination of the key matrix and the display, the flexible, translucent material having located in a position near at least one of the switches in the key matrix a surface feature that serves to assist a user touching the layer of flexible, translucent material in locating a position on a user interface in which the switch is activatable.

2. The remote control as recited in claim 1, wherein the surface feature is free of indicia which would otherwise obscure an image formed using the display.

3. The remote control as recited in claim 1, wherein the surface feature is adapted to be clicked and to restore.

4. The remote control as recited in claim 3, wherein the surface feature comprises an outwardly extending dome arranged to provide positive indication of activation of the switch.

5. The remote control as recited in claim 1, wherein the surface feature comprises a protuberance.

6. The remote control as recited in claim 5, wherein the protuberance is provided with a shape representative of an controllable appliance function.

7. The remote control as recited in claim 1, wherein the display comprises a plurality of selectively illuminable EL segments.

8. The remote control as recited in claim 1, wherein the layer of flexible, translucent material comprises a mylar material.

9. The remote control as recited in claim 1, wherein at least one of the plurality of user interfaces provides the remote control with phone functionality.

10. The remote control as recited in claim 1, wherein the surface feature is disposed directly over the switch.

11. A remote control, comprising:

a key matrix having a plurality of switches;

a flexible EL display disposed in cooperable relationship over the key matrix, the EL display comprising a plurality of individually illuminable segments wherein the segments are selectively illuminable to provide a plurality of different images in association with corresponding ones of the plurality of switches in the key matrix whereby the remote control is provided with the ability to have a plurality of different user interfaces; and wherein an exterior surface of the remote control comprises a layer of flexible, translucent material disposed over the combination of the key matrix and the display, the flexible, translucent material having located in a position directly above at least one of the switches in the key matrix a surface feature adapted to be clicked and to restore to provide positive indication of activation of the switch and which further serves to assist a user touching the layer of flexible, translucent material in locating a position on a user interface in which the switch is activatable, the surface feature being free of indicia which would otherwise obscure an image formed using the display.

12. The remote control as recited in claim 11, wherein the layer of flexible, translucent material comprises a mylar material.

13. The remote control as recited in claim 11, wherein the surface feature comprises a dome formed in the flexible, translucent material which extends outwardly away from the EL display.

14. The remote control as recited in claim 11, wherein at least one of the plurality of user interfaces provides the remote control with phone functionality.

15. A remote control and cordless phone system, comprising:

a hand-held device incorporating both a remote control having user activatable keys and a cordless phone; and a base station having a first communication interface for facilitating an exchange of telephony signals between the cordless phone and a telephony network connected to the base station and a second communication interface for facilitating control of one or more appliances on a local area network including the base station in response to appliance control communications received from the remote control;

wherein the hand-held device is operable in a first mode in which telephony communications are transmitted to the base station via use of the cordless phone for transmission onto the telephony network via the first communication interface of the base station and wherein the hand-held device is operable in a second mode in which appliance control communications are transmitted to the base station via use of the remote control in response to activation of the user activatable keys of the remote control for transmission onto the local area network via the second communication interface of the base station.

16. The system as recited in claim 15, wherein the base station is adapted to facilitate control of the one or more appliances by transmitting signals using a wireless communication protocol.

17. The system as recited in claim 15, wherein the base station is adapted to facilitate control of the one or more appliances by transmitting signals using a wired communication protocol.

18. The system as recited in claim 15, wherein the base station comprises telephone answering machine functionality.

19. The system as recited in claim 18, wherein the remote control comprises programming for remotely controlling the telephone answering machine functionality.

20. The system as recited in claim 15, wherein the remote control comprises multiple user interfaces.

21. The system as recited in claim 20, wherein the remote control is adapted to make available one or more of the multiple user interfaces as a function of a signal received from the base station.

22. The system as recited in claim 15, wherein the base station facilitates control of the one or more appliances by causing the one or more appliances to pause and resume appliance states across multiple rooms.

23. The system as recited in claim 15, wherein the remote control comprises a key matrix having a plurality of switches which provide the user activatable keys and a display disposed in cooperable relationship with the key matrix, the display being illuminable to provide a plurality of different images in association with corresponding ones of the plurality of switches in the key matrix whereby the remote control is provided with the ability to have a plurality of different user interfaces.

24. The system as recited in claim 23, wherein an exterior surface of the remote control comprises a layer of flexible, translucent material disposed over the combination of the key matrix and the display, the flexible, translucent material having located in a position near at least one of the switches in the key matrix a surface feature that serves to assist a user touching the layer of flexible, translucent material in locating a position on a user interface in which the switch is activatable.

25. The system as recited in claim 15, wherein the base station facilitates a determination of a current room location of the remote control with respect to multiple rooms in which the remote control may be located.

* * * * *